United States Patent [19]

Kunz

[11] 4,432,492

[45] Feb. 21, 1984

[54] THERMOSTATIC EXPANSION VALVE WITH REMOTE ADJUSTMENT

[75] Inventor: Bernard L. Kunz, Madison County, Ill.

[73] Assignee: Emerson Electric Co., St. Louis, Mo.

[21] Appl. No.: 350,226

[22] Filed: Feb. 19, 1982

Related U.S. Application Data

[63] Continuation of Ser. No. 136,442, Apr. 2, 1980, Pat. No. 4,325,508.

[51] Int. Cl.[3] ..... F25B 41/04

[52] U.S. Cl. ..... 236/92 B; 62/225

[58] Field of Search ..... 236/51, 92 B; 62/225; 251/294, 337; 74/89.15; 81/177 F; 64/2

[56] References Cited

U.S. PATENT DOCUMENTS

| | | | |
|---|---|---|---|
| 970,284 | 9/1910 | Wilkins | 251/337 X |
| 1,426,308 | 8/1922 | Maloney | 251/294 X |
| 2,155,233 | 4/1939 | Mantz | 236/51 X |
| 2,299,654 | 10/1942 | Ray | 251/337 X |
| 2,335,824 | 11/1943 | Dillman | 236/92.3 |
| 2,633,141 | 3/1953 | Russell | 251/294 X |
| 3,000,263 | 9/1961 | Milton et al. | 64/2 R X |
| 3,062,525 | 11/1962 | Schutmaat | 251/337 X |

*Primary Examiner*—William E. Tapolcai

*Attorney, Agent, or Firm*—Polster, Polster and Lucchesi

[57] ABSTRACT

A thermostatic expansion valve for use in a refrigeration system (e.g., a refrigerated display case) in which the superheat range of the valve may be conveniently adjusted from a location remote from the valve.

6 Claims, 6 Drawing Figures

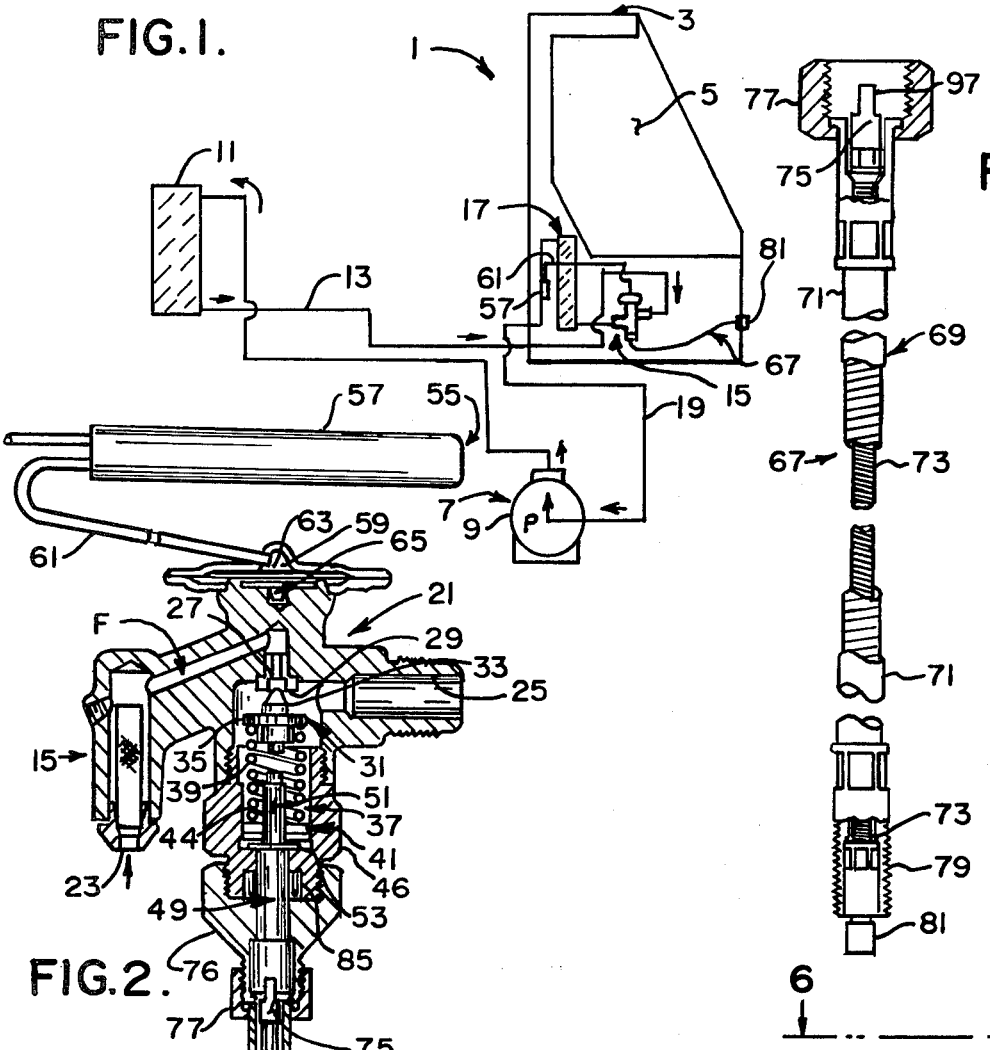
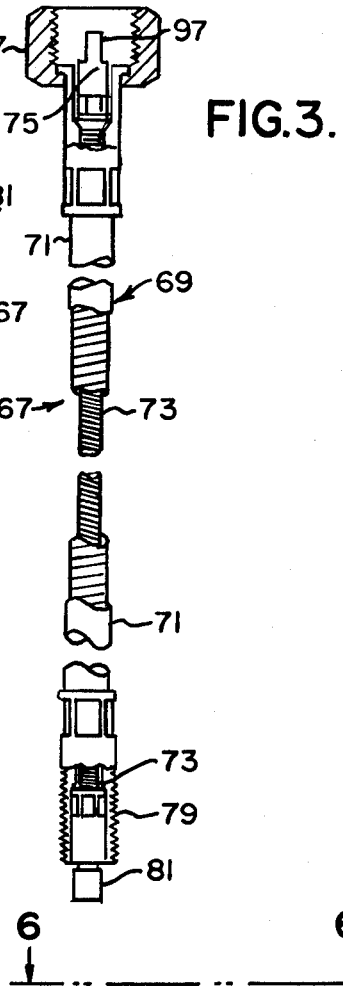
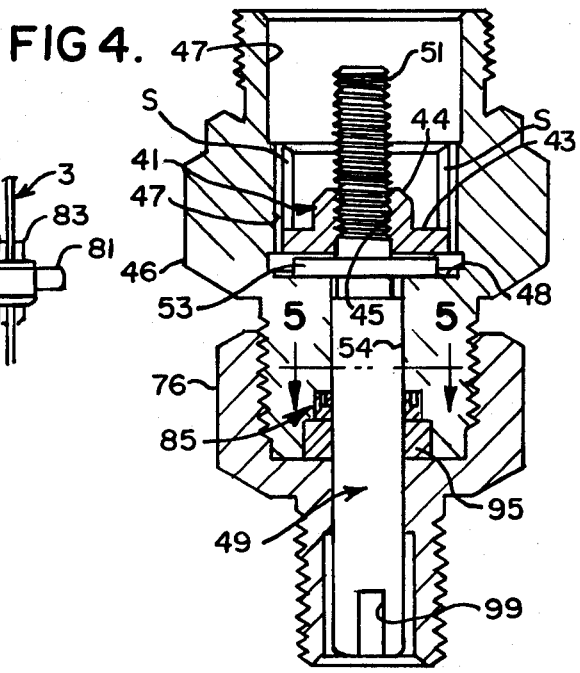
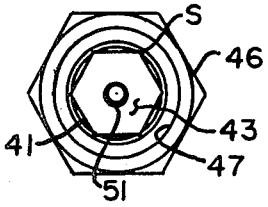
FIG. 6.
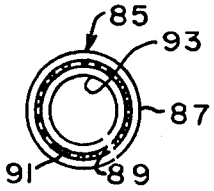
FIG. 5.
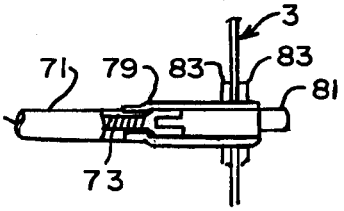

THERMOSTATIC EXPANSION VALVE WITH REMOTE ADJUSTMENT

This is a continuation of application Ser. No. 136,442, filed Apr. 2, 1980, now U.S. Pat. No. 4,325,508.

BACKGROUND OF THE INVENTION

This invention relates to a refrigeration system expansion valve, and more particularly to a thermostatic expansion valve having means enabling a service person to conveniently adjust (i.e., calibrate) the superheat setting of the expansion valve from a location remote from the valve.

In a typical refrigeration system, high pressure liquid refrigerant is expanded in an expansion valve incorporated in the liquid refrigerant line between the condenser and the evaporator coils. The low pressure, low temperature refrigerant discharged from the expansion valve is then directed through the evaporator coil for absorbing heat and thus refrigerating the space surrounding the evaporator coil. The expansion valve is adjusted to control the refrigerant flowing into the evaporator coil to a rate sufficient to maintain a desired temperature of the evaporator coil. More specifically, a thermostatic expansion valve meters the flow of refrigerant into the evaporator in proportion to the rate of evaporation of the refrigerant in the evaporator, and is responsive to the temperature of the refrigerant leaving the evaporator and to the pressure in the evaporator. In this manner, a thermostatic expansion valve can control the refrigerant leaving the evaporator at a predetermined superheat. Generally, the superheat of the refrigerant is a measure of the heat contained in the refrigerant vapor above its heat content at the boiling point (saturation temperature) at the existing pressure (i.e., the heat content of the refrigerant vapor exiting the evaporator coil which is in excess of the heat content of the vapor which normally could be expected at the refrigerant pressure as it exits the evaporator). By ensuring that the condition of the refrigerant entering the suction line from the evaporator is at a desired superheat level, the performance of the refrigeration system can be enhanced and also the return of liquid to the compressor is prevented.

A thermostatic expansion valve typically includes a spring-biased metering valve which regulates the flow of liquid refrigerant through the expansion port to the evaporator. A thermostatic bulb charged with a volatile substance is positioned in heat exchange relation with the suction line of the refrigeration system at the outlet of the evaporator. The thermostatic bulb is interconnected by means of a capillary tube to a diaphragm actuator included on the thermostatic expansion valve with the diaphragm actuator being mechanically interconnected to the metering valve of the thermostatic expansion valve. A rise in the evaporator temperature will increase the temperature of the evaporated gas passing through the suction line (i.e., increase its superheat) which in turn is sensed by the thermostatic bulb. The thermostatic bulb absorbs heat and the volatile substance therein increases its pressure and thus causes the diaphragm actuator to open the metering valve of the expansion valve and to thus proportionately increase the flow of refrigerant. Upon cooling of the evaporator, the temperature of the refrigerant discharged from the evaporator will decrease which in turn is sensed by the thermostatic bulb thereby resulting in the metering valve of the thermostatic expansion valve to at least partially close and to block at least a portion of the refrigerant flowing to the evaporator.

A thermostatic expansion valve is typically provided with an adjustment screw for varying the operating point (i.e., the superheat setting) of the valve at which the metering valve blocks or unblocks the expansion valve when the thermostatic bulb is at a specified temperature. As is conventional, this adjustment screw varies the compression of a spring biasing the metering valve member toward its closed position. Even when the thermostatic expansion valve is sized properly in relation to its respective refrigeration system, the adjustment of the thermostatic expansion valve is critical to the satisfactory and efficient operation of the refrigeration system.

In refrigeration systems, such as in refrigerated display or freezer cases installed in supermarkets, or in large ice making machines, the thermostatic expansion valve is typically located within the display case cabinet proximate the evaporator coils. While the thermostatic expansion valve may be set or calibrated prior to or during installation of the refrigerated display case, it is oftentimes not known whether the valve will be properly set once the display case is filled with meat, frozen food, or the like. In many refrigerated display cases, the expansion valve is accessible only by unloading the product from the display case and by removing service panels in the display case cabinet. Then, the superheat setting of the expansion valve may be adjusted, the service panels replaced, and the product again loaded in the refrigerated space. The unit must then be allowed to stabilize in order to check the setting of the expansion valve. Oftentimes, to properly adjust the expansion valve, several adjustments must be made until the optimum operating conditions of the refrigeration system are attained. Because this procedure requires a good deal of time and effort on the part of the serviceman, this is oftentimes not done and many refrigerated display cases are permitted to operate for extended periods of time at inefficient operating conditions thus wasting considerable amounts of energy.

Among the many objects and features of the present invention may be noted the provision of a thermostatic expansion valve, such as described above, located within a refrigerated appliance (e.g., a refrigerated display case or the like) proximate the evaporator coils thereof and being conveniently adjustable from the exterior of the refrigerated appliance at a location remote from the expansion valve;

The provision of such a thermostatic expansion valve which allows accurate calibration of superheat setting of the expansion valve to match the load conditions of the refrigeration system while the refrigerated appliance is in operation without the necessity of unloading the refrigerated appliance or without the necessity of removing service panels from the appliance for access to the expansion valve;

The provision of such a thermostatic expansion valve which can be accurately calibrated to a desired superheat setting thereby to enhance the operating efficiency of the refrigeration system; and The provision of such a thermostatic expansion valve which is economical to manufacture, easy to install in a refrigerated appliance, and which is reliable in operation.

Other objects of this invention will be in part pointed out and in part apparent hereinafter.

SUMMARY OF THE INVENTION

Briefly stated, this invention relates to a refrigerated appliance, such as a refrigerated display case or the like, including a cabinet and having a refrigerated space therewithin. At least one refrigeration coil (i.e., an evaporator) is located within the cabinet for removal of heat from the refrigerated space and from the contents contained therein. A supply line is provided for supplying pressurized refrigerant to the evaporator coil and an expansion valve is incorporated in this supply line. The expansion valve has an expansion port therein through which the refrigerant may be expanded and further has a valve member for regulating the flow of refrigerant through the expansion port. Still further, the expansion valve includes means for adjusting the valve thereby to increase or decrease the flow of refrigerant through the expansion valve. The improvement includes an actuator located remote from the expansion valve for convenient operation of the above-mentioned valve adjustment means.

BRIEF DESCRIPTION OF THE DRAWINGS

FIG. 1 is a semi-diagrammatic view of a refrigeration system including a refrigerated display case supplied with refrigerant from a central compressor, the refrigerated display case having a thermostatic expansion valve of the present invention located within the display case cabinet with the expansion valve being adjustable from a location remote from the expansion valve;

FIG. 2 is a longitudinal cross section of a thermostatic expansion valve of the present invention including means for the convenient adjustment of the expansion valve from a remote location;

FIG. 3 is a cross sectional view of a flexible shaft enabling adjustment of the thermostatic expansion valve from the above-noted remote location;

FIG. 4 is an enlarged view of a portion of the expansion valve;

FIG. 5 is a cross sectional view, taken along line 5—5 of FIG. 4 illustrating a seal for the adjustment means; and FIG. 6 is a cross-sectional view taken along the line 6—6 of FIG. 4.

Corresponding reference characters indicate corresponding parts throughout the several views of the drawings.

DESCRIPTION OF A PREFERRED EMBODIMENT

Referring now to the drawings, a refrigerated appliance (e.g., a refrigerated display case, an ice maker, or a freezer) is indicated in its entirely by reference character 1. As shown in FIG. 1, refrigerated appliance 1 has a respective cabinet 3 defining a refrigerated space 5 therewithin for containing a product (e.g., meat, frozen food, ice, etc.) to be refrigerated. A central refrigeration system, as generally indicated at 7, is provided for the refrigerated appliance.

More specifically, refrigeration system 7 includes a central refrigerant compressor 9. The output of the compressor is fed to a condensing coil, as indicated at 11. A liquid refrigerant line 13 interconnects each of the refrigerated appliances to condenser 11. An expansion valve, as generally indicated at 15, is located within cabinet 3 of the refrigerated appliance. Liquid line 13 supplies refrigerant via expansion valve 15 to a refrigerated coil (an evaporator coil) 17. A suction line 19 from the output of the evaporator coil returns the refrigerant to the compressor.

Referring now to FIG. 2, expansion valve 15 is shown to comprise a valve body 21 having a flow path, as generally indicated by F, extending therethrough. The flow path includes an inlet port 23 and an outlet port 25 adapted to be respectively connected to liquid line 13 and to evaporator coil 17. An expansion port, as generally indicated at 27, is provided within flow path F between the inlet and outlet ports. The refrigerant flowing through flow path F is discharged through the expansion port for adiabatic expansion of the refrigerant. A valve seat 29 is provided within the valve body 21, this valve seat defining expansion port 27.

Further, expansion valve 15 includes a valve member 31 having a valve needle 33 engageable with valve seat 29 for restricting or blocking the flow of refrigerant through expansion port 27. The valve member further includes a circular flange 35 for purposes as will appear.

Operation of the expansion valve is controlled by adjustment means, as generally indicated at 37. This adjustment means includes a compression coil spring 39 which resiliently biases valve member 31 toward its closed position with valve needle 33 in engagement with valve seat 29. The upper end of the compression coil spring bears on valve flange 35. A spring compression member 41 (see FIG. 4) is provided at the lower end of the compression coil spring, this spring compression member having a hex-shaped flange 43 (see FIG. 6) engageable with the bottom end of the spring and a body portion 44. A threaded axial bore 45 is provided in body portion 44.

An adapter body 46 is threaded on the lower end of valve body 21 and has a blind bore 47 therein. Bore 47 is provided with six longitudinal slots S therein for reception of the corners of the hex-shaped base 43 of spring compression member 41 thereby to permit longitudinal movement of member 41 within bore 47 so as to compress spring 39 without permitting rotation of the compression member. Further, bore 47 has a base 48.

An adjustment stem, as generally indicated at 49, is rotatably carried by adapter body 46. The adjustment stem includes a threaded stud 5 at its upper end threadably engageable within bore 45 of spring compression member 41. Further, the adjustment stem includes a bearing flange 53 engageable with the base 48 of the blind bore in of adapter body 46 thereby to transfer thrust load from the spring to the adapter body. The adjustment stem 49 extends through a central opening 54 in the base of the adapter body 46 and is rotatable relative to the adapter body for threadably advancing or retracting spring compression member 41 along the length of threaded stud 51 thereby to respectively compress or extend compression coil spring 39 and to thus vary the biasing force on valve member 31 tending to close the valve member.

Expansion valve 15 is shown to include a thermostatic control, as generally indicated at 55, for governing operation of the expansion valve in response to changes in temperature of the refrigerant entering suction line 19 from evaporator coil 17. More specifically, thermostatic control 55 is shown to include a thermostatic expansion bulb 57 located remote from valve body 21 and secured to suction line 19 adjacent evaporator coil 17 in heat transfer relation with the suction line. As is typical, expansion bulb 57 is clamped to the outer surface of the suction line so as to sense the temperature of the refrigerant discharged from the evaporator coil. Expansion bulb 57 is filled with a volatile fluid and is connected to a diaphragm chamber 59 provided on valve body 21 by means of an elongate capillary tube 61. A flexible diaphragm 63 is provided in diaphragm chamber 59 and is movable in response to changes in pressure exerted on the diaphragm by the volatile fluid contained within the expansion bulb 57 and capillary tube 61. As is typical, a linkage, as generally indicated at 65, mechanically interconnects diaphragm 63 and valve member 31 so that the pressure force exerted on the diaphragm by the volatile fluid in of the expansion bulb can be transferred to the valve member thereby to vary the net biasing force exerted on the valve member by compression coil spring 39, by linkage 65, and by the evaporator pressure.

With adjustment stem 49 set so as to compress compression coil spring 39 a desired amount and to apply a desired closing force on valve member 31, the pressure exerted on diaphragm 63 by the volatile fluid in expansion bulb 57 will cause the expansion valve to open and close so as to maintain a desired amount of refrigerant flow through the expansion valve thereby to maintain the temperature of the refrigerant discharged from the evaporator at a desired temperature or superheat level. If the temperature of the refrigerant exiting evaporator 17 increases, the force exerted on diaphragm 63 by the volatile fluid will increase the force exerted on valve member 31 by linkage 65 and thus the valve member will be forced away from valve seat 29 thereby to further open the expansion valve and to allow a greater quantity of refrigerant to flow to the evaporator coil. The wider the valve opens, a greater percentage of coil flooding results and this improves heat transfer to the refrigerant flowing through evaporator 17. Upon the temperature of the refrigerant cooling, the pressure force exerted on diaphragm 63 by the volatile fluid will decrease thus allowing the force of compression coil spring 39 to close the expansion valve and to at least partially block the flow of refrigerant therethrough.

As so far described, refrigerated appliance 1, refrigeration system 7, and expansion valve 15 are substantially conventional, and do not, per se, constitute part of the improvement of this invention.

In accordance with this invention, actuator means, as generally indicated 67, is provided for the remote adjustment of the superheat setting of expansion valve 15 whereby the superheat setting of the expansion valve may be accurately and conveniently adjusted by a repairman from the exterior of cabinet 3 of refrigerated appliance 1 without the necessity of having to remove the refrigerated product from refrigerated space 5 or without the necessity of having to remove service panels (not shown) from the interior or exterior of the cabinet for access to the thermal expansion valve. More specifically, this remote adjustment means is shown to comprise an elongate, flexible shaft 69 coupled to adjustment stem 49 and extending to a convenient location on the exterior of refrigerated appliance cabinet 3. Flexible shaft 69 is shown to comprise an outer, flexible sheath 71 with an inner, flexible core 73 rotatable within the sheath. A coupler 75 is secured to the inner end of rotary core 73 for coupling the rotary core to the outer end of adjustment stem 49 whereby, rotation of the inner core in one direction or the other results in increasing or decreasing the biasing force exerted by compression coil spring 39 on valve member 31. An adapter 76 is threaded on the bottom end of body 46. A securement nut 77 is provided on the inner end of flexible shaft 69 for threadably connecting the shaft to the bottom end of adapter 76 and for holding coupler 75 in coupled relation with adjustment stem 49.

As shown in FIG. 1, flexible shaft 69 is of a length sufficient to permit the shaft to be routed to a location on the exterior of cabinet or refrigerated appliance 1 remote from the location of expansion valve 15 within the refrigerated appliance so as to permit convenient adjustment of the expansion valve. A threaded fitting 79 is provided on the outer end of sheath 71, this thread fitting being insertable through a hole provided in cabinet 3. A drive member 81 secured to the outer end of rotary core 73 projects out beyond the end of threaded fitting 79 for rotation of inner core 73. As shown in FIG. 3, plate nuts 83 may be threaded on fitting 79 thereby to secure the fitting in desired relation on the wall of cabinet 3. It will be understood that drive 81 may be square-shaped in cross section thereby to enable a service technician to fit a wrench on the drive for rotation of inner core 73. Alternatively, drive 81 may be provided with a diametric slot (not shown) thereacross so as to enable the drive to be rotated by a screwdriver. Additionally, a protective cap (also not shown) may be threaded onto to the end of fitting 79 thereby to enclose and protect drive 81 and to prevent the inadvertant adjustment of the expansion valve.

As indicated above, adjustment stem 49 is rotatable with respect to adapter body 46. Since the inner end of adjustment stem 49 is in communication with flow path F through valve body 21, a seal, as generally indicated at 85, is provided in adapter body 46 (see FIG. 4) for rotatably sealing adjustment stem 49 with respect to the adapter body. As shown in FIG. 5, adjustment stem seal 85 includes a seal body 87 preferably molded of a synthetic resin material, such as a suitable tetrafluoroethylene resin, having a circular, circumferential groove 89 molded in one end face thereof. A circular spring 91 is positioned within the groove 89 and the seal body includes a central bore 93 for sealably receiving of adjustment stem 49. When assembled, as shown best in FIG. 4, and when adapter 76 is threaded on adapter body 46, a spacer 95 between adapters 46 and 76 holds seal 85 in position to seal rotary adjustment stem 49 with respect to adapter body 46. Seal 85 is said to be self-sealing in that with spring 91 directed toward valve 15, pressure enters groove 89 and forces the sides of the seal outwardly into sealing engagement with stem 49 and adapter body 49. Thus, the greater the pressure, the greater the sealing action exerted by the seal.

It will be appreciated that the requirement of a low leakage seal, such as seal 85, is required when the remote actuator of the present invention is utilized to insure refrigerant leakage rates within acceptable limits (e.g., less than about one ounce of refrigerant per year). This stringent leak rate for the seal is mandated because with the remote actuator, a seal cap conventionally used to seal the adjustment stem cannot be utilized.

As shown best in FIGS. 3 and 4, coupler 75 has a finger 97 of rectangular cross section extending endwise therefrom adapted to be received in a corresponding slot 99 in the outer end of adjustment stem 49. With finger 97 received in slot 99 (i.e., with coupler 75 and adjustment stem 49 axially interfitted), stem 49 will rotate with core 73. Of course, this finger and slot arrangement allows flexible shaft 69 to be readily installed on or removed from expansion valve 15.

With thermostatic expansion valve 15 installed within refrigerated appliance 1 as shown in FIG. 1, with remote adjustment means 67 connected to the expansion valve as shown in FIG. 2, with drive 81 located on the exterior of cabinet 3, and with product in refrigerated space 5, the refrigerated appliance is turned on and permitted to come to operating equilibrium. With refrigerated appliance 3 operating, drive 81 may be rotated in one direction or the other so as to selectively vary the biasing force of spring 39 on valve member 31 and to thus selectively vary the superheating setting of expansion valve 15. In one construction of valve 15, one turn of drive 81 in one direction or the other will vary the superheat setting of the valve by about 3° F. (1.6° C.). After the superheat setting of the expansion valve has been changed a desired amount, the serviceman then observes operation of the refrigerated appliance, and, if it is not operating satisfactorily, he can then make further adjustments of the superheat setting of the valve as may be required. It will be noted that, in accordance with this invention, access to expansion valve 15 is not required for adjustment of its superheat setting, but rather the expansion valve can be readily and conveniently adjusted from the exterior of cabinet 3. This not only facilitates adjustment of the expansion valve but also insures that such important adjustments will be made because such adjustments are not nearly as laborious for the serviceman to perform.

In view of the above, it will be seen that the several objects and features of this invention are attained and other advantageous results attained.

As various changes could be made in the above construction without departing from the scope of the invention, it is intended that all matter contained in the above description or shown in the accompanying drawings shall be interpreted as illustrative and not in a limiting sense.

What is claimed is:

1. In a thermostatic expansion valve for a refrigeration system, said valve comprising a a valve housing having a flow path therethrough, said flow path having an inlet, an outlet, and an expansion valve seat constituting a expansion port between said inlet and said outlet, said inlet and said outlet being adapted to be connected to a liquid line of the refrigeration system for the passage therethrough of pressurized refrigerant, a valve member movable toward and away from said valve seat thereby to regulate the flow of refrigerant through said flow path, a compression coil spring for biasing said valve member toward a closed position in which said valve member cooperates with said valve seat thereby to regulate the flow of refrigerant through said flow path, expansion bulb and diaphragm means operatively connected to said valve member responsive to the load on said refrigeration system, said expansion bulb and diaphragm means and said spring operating on said valve member so as to maintain the flow of refrigerant through said flow path within a desired superheat range, and means for adjusting the superheat range of the thermal expansion valve, this last-said adjustment means comprising a spring compression member engageable with one end of said spring and being selectively axially movable relative to said spring thereby to compress or relax said spring throughout a predetermined range and thereby to vary the superheat range of said thermostatic expansion valve, wherein the improvement comprises: an adjustment stem rotatable with respect to said valve housing and having a flange engageable with said valve housing so as to prevent axial movement of said stem, said adjustment stem being threadably engageable with said spring compression member and being rotatable through a plurality of revolutions thereby to effect axial movement of said spring compression member throughout said predetermined range upon rotation of said ajustment stem, an elongate flexible shaft, one end of said flexible shaft being coupled to said adjustment stem, means for sealing said adjustment stem with respect to said housing and for permitting rotation of said adjustment means relative to said housing, said flexible shaft having a drive member on its outer end and being unaffected by the compression force of said spring, rotation of said drive member effecting corresponding rotation of said adjustment stem relative to said valve housing thereby permitting convenient adjustment of the superheat range of said thermal expansion valve from a location remote from said thermal expansion valve.

2. In a thermostatic expansion valve as set forth in claim 1 wherein said flexible shaft comprises a sheath and a core rotatable within said sheath, a coupler secured to said core engageable with said adjustment stem for effecting rotation of said adjustment stem in one direction or the other upon rotation of said core.

3. In a thermostatic expansion valve as set forth in claim 2 wherein said coupler and said adjustment stem are axially interfitted with one another and are rotatable as a unit when so axially interfitted with one another.

4. In a refrigerated appliance having a cabinet, a refrigeration system within said cabinet, said refrigeration system including a refrigeration coil, a supply line for suppling pressurized refrigerant to said refrigeration coil, and an expansion valve incorporated in said supply line, said expansion valve having a valve body, a flow path for said refrigerant through said valve body, a valve seat in said flow path, a valve member movable axially within said body toward and away from said valve seat for regulating the flow of refrigerant through said flow path, a spring for biasing said valve member into engagement with said valve seat, a rotary means on said valve body for axially adjusting the force of said spring exerted on said valve member thereby to selectively increase or decrease the flow of refrigerant through said valve to said refrigeration coil, wherein the improvement comprises: an adjustment member rotatably mounted within said valve body and having a flange engageable with said valve body so as to prevent axial movement relative to said valve body, means cooperable with said adjustment member and being axially movable relative to said spring in response to rotation of said adjustment member thereby to selectively compress or relax said spring, means for sealing said adjustment stem with respect to said housing and for permitting rotation of said adjustment means relative to said housing, and an actuator on the exterior of said cabinet operatively coupled to said adjustment member for remotely effecting rotation of said adjustment member from a location remote from said valve in said cabinet, said adjustment member transferring the force of said spring to said valve body thereby to free said actuator of the compression force of said spring and to enable convenient adjustment of said valve from the exterior of said cabinet.

5. In a refrigerated appliance as set forth in claim 4 wherein said remote adjustment actuator comprises a drive member mounted on the exterior of said cabinet and an elongate, flexible shaft rotatably coupling said drive member to said adjustment member thereby to permit rotary adjustment of said adjustment member from the exterior of said cabinet.

6. In a refrigerated appliance as set forth in claim 4 further including means for sealing said adjustment member with respect to said expansion valve and for permitting rotation of said adjustment members relative to said expansion valve.

* * * * *